US007520077B2

(12) United States Patent
Riley

(10) Patent No.: US 7,520,077 B2
(45) **Date of Patent: *Apr. 21, 2009**

(54) CUSHIONED WRISTBAND WITH SELF-LAMINATING IDENTITY TAG

(75) Inventor: James M. Riley, St. Louis, MO (US)

(73) Assignee: Laser Band, LLC, St. Louis, MO (US)

( * ) Notice: Subject to any disclaimer, the term of this patent is extended or adjusted under 35 U.S.C. 154(b) by 511 days.

This patent is subject to a terminal disclaimer.

(21) Appl. No.: 10/870,500

(22) Filed: Jun. 17, 2004

(65) Prior Publication Data

US 2005/0279001 A1 Dec. 22, 2005

(51) Int. Cl.
*A44C 5/00* (2006.01)

(52) U.S. Cl. ..... 40/633; 283/75

(58) Field of Classification Search ..... 40/633; 283/81

See application file for complete search history.

(56) References Cited

U.S. PATENT DOCUMENTS

| | | | | |
|---|---|---|---|---|
| 230,455 | A | 7/1880 | Wilcox | |
| 919,983 | A | 4/1909 | Walsh | |
| 922,948 | A | 5/1909 | Portmore | |
| 1,517,456 | A | 2/1924 | Pulliam | |
| 2,054,227 | A * | 9/1936 | Nichols | 40/665 |
| 2,073,280 | A | 3/1937 | Lederer | |
| 2,553,676 | A | 5/1951 | Roos | |
| 2,641,074 | A | 6/1953 | Richmond | |
| 3,197,899 | A | 8/1965 | Twentier | |
| 3,402,808 | A | 9/1968 | Yannuzzi | |
| 3,660,916 | A | 5/1972 | McDermott et al. | |
| 3,854,229 | A | 12/1974 | Morgan | |
| 4,004,362 | A | 1/1977 | Barbieri | |
| 4,078,324 | A | 3/1978 | Wiebe | |

(Continued)

FOREIGN PATENT DOCUMENTS

| | | |
|---|---|---|
| EP | 1039431 | 9/2000 |

(Continued)

OTHER PUBLICATIONS

Posey Movable I.D. Bracelet, web archive Mar. 2003, www.posey.com.*

European Patent Office, Patent Abstracts of Japan, JP 2003 164307 (Sato Corp.), Jun. 10, 2003.

Disaster Management Systems, Inc., Triage Tag, Copyright 1996, Pomona, California.

Maryland Department of Transportation, Maryland Emergency Medical Services, Triage Tag, Copyright MIEMMS 1999, Maryland.

(Continued)

*Primary Examiner*—Joanne Silbermann
(74) *Attorney, Agent, or Firm*—Thompson Coburn LLP

(57) ABSTRACT

A cushioned wristband includes a carrier having a multi-layered band portion and a strap sewn to the back of the band portion of the carrier. The band has a surface with loop material and the strap has a surface of hook material, the hook and loop surfaces being intended to secure the band in place as it is wrapped about a patient's appendage. The strap is appropriately sized to insert through one or both of two cinch slots of a self-laminating hang tag which may be printed with patient information and separated from a sheetlet or page sized business form processed through a printer for imaging of patient information thereon. The band portion of the carrier includes a cushioned layer of soft foamy or spongy material for contacting a patient's skin to thereby substantially eliminate any possibility for abrasion, rash, or other irritation or injury to the patient through wearing of the wristband.

19 Claims, 5 Drawing Sheets

U.S. PATENT DOCUMENTS

| | | | |
|---|---|---|---|
| 4,179,833 | A | 12/1979 | Knodel |
| 4,226,036 | A | 10/1980 | Krug |
| 4,233,715 | A | 11/1980 | McDermott |
| 4,612,718 | A | 9/1986 | Golub et al. |
| 4,627,994 | A | 12/1986 | Welsch |
| 4,682,431 | A | 7/1987 | Kowalchuk |
| 4,696,843 | A | 9/1987 | Schmidt |
| 4,783,917 | A | 11/1988 | Smith et al. |
| 4,829,604 | A | 5/1989 | Allen et al. |
| 4,854,610 | A | 8/1989 | Kwiatek |
| 4,855,277 | A | 8/1989 | Walter |
| 4,914,843 | A | 4/1990 | DeWoskin |
| 4,941,210 | A | 7/1990 | Konucik |
| 4,956,931 | A | 9/1990 | Selke |
| 4,991,337 | A | 2/1991 | Solon |
| RE33,616 | E | 6/1991 | Welsch |
| 5,026,084 | A | 6/1991 | Pasfield |
| 5,045,426 | A | 9/1991 | Maierson et al. |
| 5,135,789 | A | 8/1992 | Schmidt |
| 5,222,823 | A | 6/1993 | Conforti |
| 5,227,004 | A | 7/1993 | Belger |
| 5,227,209 | A | 7/1993 | Garland |
| 5,283,969 | A | 2/1994 | Weiss |
| 5,311,689 | A | 5/1994 | Lindsey |
| 5,318,326 | A | 6/1994 | Garrison |
| 5,351,993 | A | 10/1994 | Wright |
| 5,370,420 | A | 12/1994 | Khatib et al. |
| 5,383,686 | A | 1/1995 | Laurash |
| 5,418,026 | A | 5/1995 | Dronzek, Jr. et al. |
| 5,427,416 | A | 6/1995 | Birch |
| 5,486,021 | A | 1/1996 | Laurash |
| 5,486,436 | A | 1/1996 | Lakes |
| 5,509,693 | A | 4/1996 | Kohls |
| 5,509,694 | A | 4/1996 | Laurash et al. |
| 5,518,787 | A | 5/1996 | Konkol |
| 5,524,934 | A | 6/1996 | Schwan et al. |
| 5,547,227 | A | 8/1996 | Laurash et al. |
| 5,581,924 | A | 12/1996 | Peterson |
| 5,586,788 | A | 12/1996 | Laurash |
| 5,595,404 | A | 1/1997 | Skees |
| 5,598,970 | A | 2/1997 | Mudry et al. |
| 5,601,313 | A | 2/1997 | Konkol et al. |
| 5,630,627 | A | 5/1997 | Stewart |
| 5,637,369 | A | 6/1997 | Stewart |
| 5,648,143 | A | 7/1997 | Mehta et al. |
| 5,653,472 | A | 8/1997 | Huddleston et al. |
| 5,662,976 | A | 9/1997 | Popat et al. |
| 5,687,903 | A | 11/1997 | Akridge et al. |
| 5,765,885 | A | 6/1998 | Netto |
| 5,842,722 | A | 12/1998 | Carlson |
| 5,877,742 | A | 3/1999 | Klink |
| 5,933,993 | A | 8/1999 | Riley |
| 5,984,363 | A | 11/1999 | Dotson et al. |
| 6,000,160 | A | 12/1999 | Riley |
| 6,006,460 | A | 12/1999 | Blackmer |
| 6,016,618 | A | 1/2000 | Attia et al. |
| 6,053,535 | A | 4/2000 | Washburn et al. |
| 6,067,739 | A | 5/2000 | Riley |
| 6,071,585 | A | 6/2000 | Roth |
| 6,092,321 | A | 7/2000 | Cheng et al. |
| 6,155,476 | A | 12/2000 | Fabel |
| 6,155,603 | A | 12/2000 | Fox |
| 6,159,570 | A | 12/2000 | Ulrich et al. |
| 6,303,539 | B1 | 10/2001 | Kosarew |
| 6,331,018 | B1 | 12/2001 | Roth et al. |
| 6,343,819 | B1 | 2/2002 | Shiozaki |
| 6,361,078 | B1 | 3/2002 | Chess |
| 6,409,871 | B1 | 6/2002 | Washburn et al. |
| 6,438,881 | B1 | 8/2002 | Riley |
| 6,510,634 | B1 | 1/2003 | Riley |
| 6,517,921 | B2 | 2/2003 | Ulrich et al. |
| 6,611,962 | B2 | 9/2003 | Redwood et al. |
| 6,685,228 | B2 | 2/2004 | Riley |
| 6,748,687 | B2 | 6/2004 | Riley |
| 6,807,680 | B2 | 10/2004 | Sloot |
| 6,836,215 | B1 | 12/2004 | Laurash et al. |
| 6,863,311 | B2 | 3/2005 | Riley |
| 7,017,294 | B2 | 3/2006 | Riley |
| 7,047,682 | B2 | 5/2006 | Riley |
| 7,222,448 | B2 | 5/2007 | Riley |
| 7,240,446 | B2 | 7/2007 | Bekker |
| 2002/0176973 | A1 | 11/2002 | Keiser |
| 2003/0011190 | A1 | 1/2003 | Ryan |
| 2004/0060216 | A1 | 4/2004 | Riley |
| 2004/0068906 | A1 | 4/2004 | Riley |
| 2004/0244251 | A1 | 12/2004 | Riley |
| 2005/0108912 | A1 | 5/2005 | Bekker |
| 2005/0279001 | A1 | 12/2005 | Riley |
| 2005/0281989 | A1 | 12/2005 | Finger |
| 2006/0230661 | A1 | 10/2006 | Bekker |
| 2006/0236578 | A1 | 10/2006 | Saint et al. |
| 2007/0089342 | A1 | 4/2007 | Jain et al. |

FOREIGN PATENT DOCUMENTS

| | | | |
|---|---|---|---|
| FR | 2806594 | A | 9/2001 |
| GB | 960859 | | 6/1974 |
| GB | 2 045 718 | | 11/1980 |
| GB | 2 160 492 | | 12/1985 |
| GB | 2228915 | A | 9/1990 |
| JP | 2002351321 | A | 12/2002 |
| JP | 2003066849 | | 3/2003 |
| JP | 2003157010 | | 5/2003 |
| JP | 2006039209 | | 2/2006 |
| WO | WO 96/12618 | | 5/1996 |
| WO | 98/23081 | | 5/1998 |
| WO | 99/18817 | | 4/1999 |
| WO | 0239412 | | 5/2002 |
| WO | 03003331 | | 1/2003 |
| WO | 2004028826 | | 4/2004 |
| WO | 2005064574 | | 7/2005 |
| WO | 2006007356 | | 1/2006 |
| WO | 2007/021375 | | 2/2007 |
| WO | 2007/133906 | | 11/2007 |

OTHER PUBLICATIONS

Patent Cooperation Treaty; Partial International Search Report; Sep. 13, 2004.
Standard Register; *P.S. Magazine*; Fall 1998; Dayton, Ohio.
Berry, Gretchen; "Wrist Watch"; *Advance for Healthcare Information Professionals*; Feb. 15, 1999.
Sample of Standard Register Label.
"Yes, Sir, That's My Baby!"; *Material Management in Health Care*; Feb. 1999; vol. 8, No. 2; Health Forum, Inc.
Brochure entitled: "Color-Bar®—Click Strip™ Labeling System"; Smead Manufacturing Company; Date Unknown; Form No. SSS-CS-00.
Brochure entitled: "Color-Bar® Folders"; Smead Manufacturing Company; Date Unknown.
Brochure entitled: "Integrated Document Management Software"; Smead Manufacturing Company; Date Unknown; Form No. SLI-95.
Catalog entitled: "Reseller Catalog Number One"; Smead Software Solutions™; Date Unknown; Form No. SSS-RC1-00.
Sample of Standard Register Labels.
Sample of Avery Dennison DuraCard™ Labels.
Posey Movable I.D. Bracelet; downloaded from http://www.posey.com/products/4648.html on Aug. 18, 2004.
Avery Laminated Identification Card #5361.
ID Warehouse (http://web.archive.org/web/20050131235601/http://idwarehouse.com/) Jan. 31, 2005. p. 1: WB1908, Stock Vinyl Wristband.

* cited by examiner

CUSHIONED WRISTBAND WITH SELF-LAMINATING IDENTITY TAG

BACKGROUND AND SUMMARY OF THE INVENTION

The inventor herein has previously invented multiple designs for self-laminating wristbands principally for use with patients in a medical or hospital setting. Examples of these may be found in his previously-issued U.S. Pat. Nos. 5,933,993; 6,000,160; 6,067,739; 6,438,881; 6,510,634; and 6,685,228 along with other patent applications pending for further designs, improvements, and inventive techniques and methods relating thereto, the disclosures of which are incorporated herein by reference. Included among these various inventions and designs are self-laminating wristbands intended for use with newborn babies including those delivered prematurely. As is well known, these babies and especially premature babies have extremely sensitive skin in many instances so that any wristband or other object placed around the baby's wrist or ankle must carefully allow for that sensitivity. Furthermore, babies are well known to move their arms and legs in a herky-jerky or flailing fashion, rub their eyes, and otherwise move about as they experience the new world that they have entered. In many instances, these newborn babies can become agitated and cry which can have a tendency to accentuate or intensify their arm and leg movements. Of course, as their hands, arms and legs move, they come in contact with other sensitive areas, such as, for example, their face, which could in some instances become scratched and in rare instances even injure the baby.

The inventor's previous designs include wristbands intended for these smaller babies including babies which might even be in intensive care and various features are provided to greatly minimize any possibility of discomfort, rash, or other injury to occur. Nevertheless, despite the great commercial success and widespread adoption and use of the inventor's wristband inventions, which have provided a significantly safer wristband for use with these babies, the inventor has continued his efforts to improve upon these designs even further so as to completely eliminate even the slightest possible chance of irritation or injury to the baby.

As a result of his continuing efforts, the inventor herein has succeeded in designing and developing a cushioned wristband which makes it virtually impossible for a baby who wears this wristband to experience a rash, discomfort, or even any injury as a result of the baby's boisterous conduct. In simple terms, this latest invention of a cushioned wristband includes a cushioned carrier for extending around the baby's wrist or ankle with a fastening strap preferably sewn to and extending from one side thereof. The strap preferably has one surface covered with Velcro™ hook-type fastener material while the carrier has a surface covered with Velcro™ loop material. The opposite surface of the carrier which comes into contact with the baby's skin is preferably any hypoallergenic, soft, cushioning material. The strap is preferably sized to thread through a self-laminating tag which may be processed through a laser printer and is similar in construction to many of the inventor's previous wristband designs. In essence, this self-laminating tag preferably comprises an imaging area of face stock material and an underlying self-laminating portion approximately twice the size of the imaging area with cinch slots preferably positioned in the lamination and preferably on either side of the imaging area. In use, the tag may be processed through a laser printer for printing with the patient's name, doctor's name, a barcode identifier, date of admission, and any other information as desired. The tag may then be separated from a sheetlet sized or page sized or other conveniently sized business form, the lamination folded over to self laminate the tag, and then applied to the carrier by inserting the strap through one or both of the cinch slots. Once fully assembled, the wristband may then be wrapped around the baby's wrist and the strap affixed to the back of the carrier by joining the hook and loop material of a Velcro™ fastener to thus secure the wristband to the baby. Preferably, the wristband is sized to allow for the cushioning material to wrap entirely around the baby's wrist, ankle, etc., and preferably overlap so that just the cushioning material contacts the baby's skin.

A somewhat similar prior art device is shown in FIG. 1. It comprises a wristband 100P made of cushioning material 102P with a backing of Velcro™ loop material 104P, with a short strap 106P sewn to one side thereof and having a Velcro™ hook material 108P arranged for securing the wristband. Sewn on the back of the wristband is a panel 110P to which a patient label 112P may be adhered. This patient label 112P may be provided as part of another form and printed such as by processing through a laser printer. It is noted that the patient label is exposed and not laminated, thereby requiring it to be made of a resilient material such as a vinyl or other durable material to withstand the moisture, body fluids and other abuse it will receive. Furthermore, there is no positive or mechanical attachment of the patient label to the wristband so that as it becomes worn and abused, the patient label is likely to become illegible or even detach which could lead to failure of the wristband in its essential purpose of reliably identifying the baby. With the wristband of the present invention, the cinch slots provide a positive mechanical attachment of a laminated patient label which makes it virtually impossible for it to become illegible or detached, thereby providing dramatically improved performance. The prior art patient label is not conveniently removed for refreshing the patient label with a new one, and instead it is thought that a new patient label would need to be adhered over the top of the existing patient label. This construction leads to attachment of a second patient label in a manner less secure than the original, unless extreme care is taken to prepare the panel for receiving the new patient label which is unlikely to happen in the hospital environment. Nurses have better things to do with their time than clean and prepare surfaces for receiving a new patient label. With the present invention, refreshment of a patient label is rarely necessary, and if necessary, can be achieved in a few steps by removing the wristband, sliding off the old patient label and sliding on the new patient label, and then replacing the wristband back on the baby. No cleaning of a surface, or peeling of the old label, is required. Furthermore, the replacement patient label is secured just as well as the original patient label. The present invention thus represents a dramatic step forward over this prior art construction.

There are many new features and advantages provided by the present invention. Some of these include the following. The self-laminating tag may be conveniently provided on a sheetlet or full-page size form for convenient processing through a laser printer at the time of admission along with other forms including other wristbands and labels as may be later used for the baby. Thus, the advantages as noted in the inventor's prior patents are carried forward with this invention in that regard. The self-laminating tag may be firmly secured either loosely or closely about the baby's wrist or ankle with only a cushioning material contacting the baby's skin to thereby provide reliable identification with a durable tag yet without any discomfort to the baby. The carrier is adjustable as it can be wrapped around itself to provide a variable length so that it may be used with babies of different size or age. In other words, the wristband carrier is sized and arranged with its hook and loop fastener to be adjustable in length and fit either loosely or tightly to the baby's appendage. The hang tag may be attached with either one or both of the cinch slots, as desired. If attached with a single cinch slot, the tag in essence is free to move with respect to the wristband and thereby be more readily accessible and remain flat for easier bar code scanning. If attached with the strap extending through both slots, the tag may be secured more tightly against the carrier, less subject to inadvertent detachment, and less likely to be inadvertently brought into contact with the baby. The wristband is relatively inexpensive yet durable and flexible in that, should a tag be desired to be changed as a result of heavy abuse, it may be conveniently done without reprocessing in many instances as additional tags may be conveniently printed at the time of admission. By being self laminating, the tag is protected from the various bodily fluids likely for it to come in contact with as the baby is fed or administered medicine orally, the baby drools, and the baby otherwise performs its bodily functions. As the hang tag is detachable, the carrier may be reused as desired or in shortage or emergency situations thereby making the entire wristband system more flexible. Indeed, the carrier may itself be washed in that same regard. The hang tag may be provided as part of a larger assemblage of wristband forms such that a single set of forms may be preprinted and available for usage as the baby's stay progresses and even to accommodate those relatively few occasions when the baby is kept for an extended stay.

While the principal advantages and features of the invention have been briefly described above, a more thorough understanding and appreciation for the invention and its advantages may be obtained by referring to the drawings and description of the preferred embodiment which follow.

DETAILED DESCRIPTION OF THE PREFERRED EMBODIMENT

Figure 2:
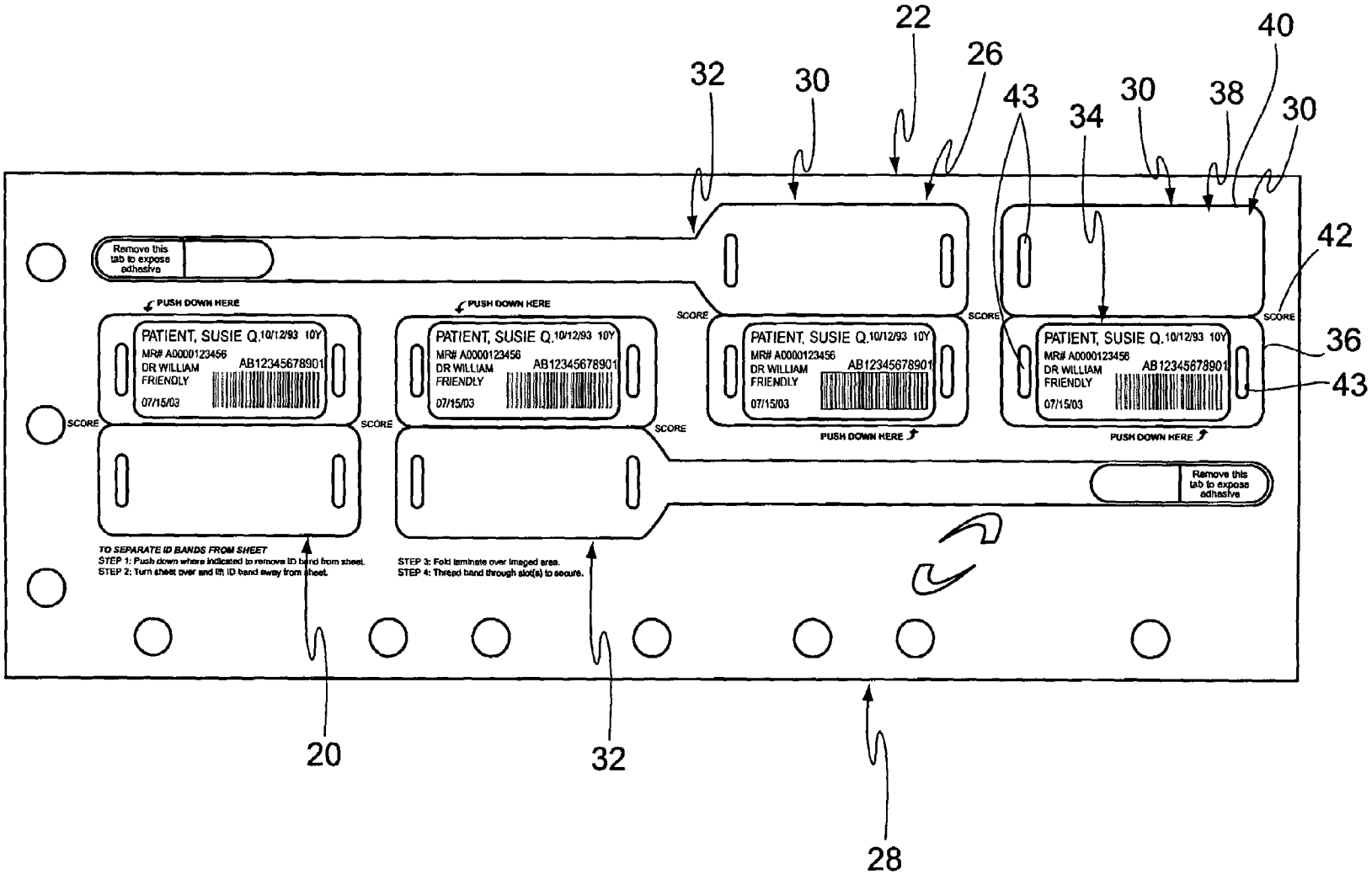
FIG. 2 is a top view of a sheetlet sized business form having a pair a self-laminating wristbands and a pair of self-laminating hang tags for use with the cushioned carrier as shown in FIG. 4.
Figure 3:
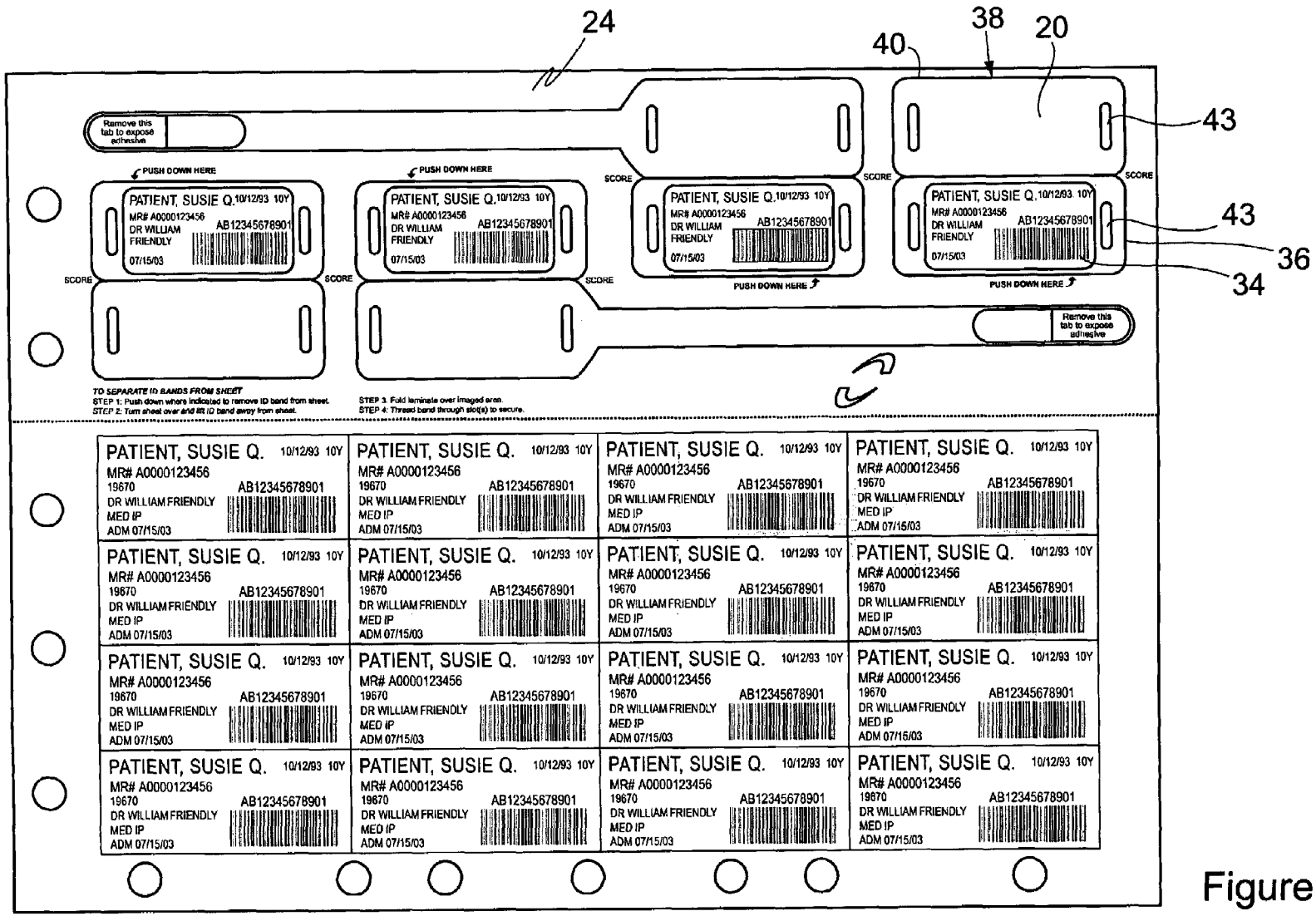
FIG. 3 is a top view of a full-page sized "combo" form having an upper portion containing a pair of self-laminating wristbands as well as a pair of self-laminating hang tags and a bottom portion having a matrix of printable self-adhesive labels.

As shown in FIGS. 2 and 3, the self-laminating hang tag 20 is provided as part of a multi-web business form shown as a sheetlet 22 in FIG. 2 or a page sized combination form 24 as shown in FIG. 3. The sheetlet 22 is approximately envelope sized for convenient processing through a laser printer, as is known in the art and as explained in the inventor's prior patents mentioned above. The sheetlet 22 is generally comprised of two plies, an upper face ply 26 joined to an underlying laminate ply 28, the self-laminating portions of which are shown in outline 30 on the sheetlet 22. A pair of hang tags 20 as well as a pair of self-laminating wristbands 32 are conveniently sized to fit within the confines of the sheetlet 22. Of particular interest for purposes of the present invention are the hang tags 20. Each of these include an imaging area 34 defined by a die cut 36 in the face stock layer 26 and an underlying laminating portion 38 defined by a die cut 40 in the laminate layer 28. A pair of cinch slots 43 are preferably provided in the laminating portion 34 and straddling the imaging area 34. These cinch slots are used to attach the hang tag 20 to the carrier 44, as is explained below in greater detail. As shown in FIGS. 2 and 3, the cinch slots 43 may be approximately 7/16 inches long by approximately 1/16 inches wide and spaced approximately 1¾ inches apart, or otherwise appropriately sized to allow for the hang tag 20 to be slidingly attached, as explained below. More particularly, the inventor contemplates that the cinch slots 43 should be preferably sized so as to minimize the possibility for the hang tag 20 to shift once the wristband has been applied to the baby. The self-laminating hang tag 20 is conveniently separated from the sheetlet 22 and the lamination portion 38 is folded about a score line 42 to completely encapsulate the imaging area 34. Of course, the imaging area 34 may be processed through a laser printer and printed with patient information upon admittance of the patient or, as with the case of a baby, birth of the baby. In addition to being provided in sheetlet 22 form, the wristbands 32 and hang tags 20 may also be provided as part of a page sized combo form 24 as shown in FIG. 3. The construction of the combo form 24 is explained in greater detail in one or more of the inventor's prior patents as mentioned above.

Figure 1:
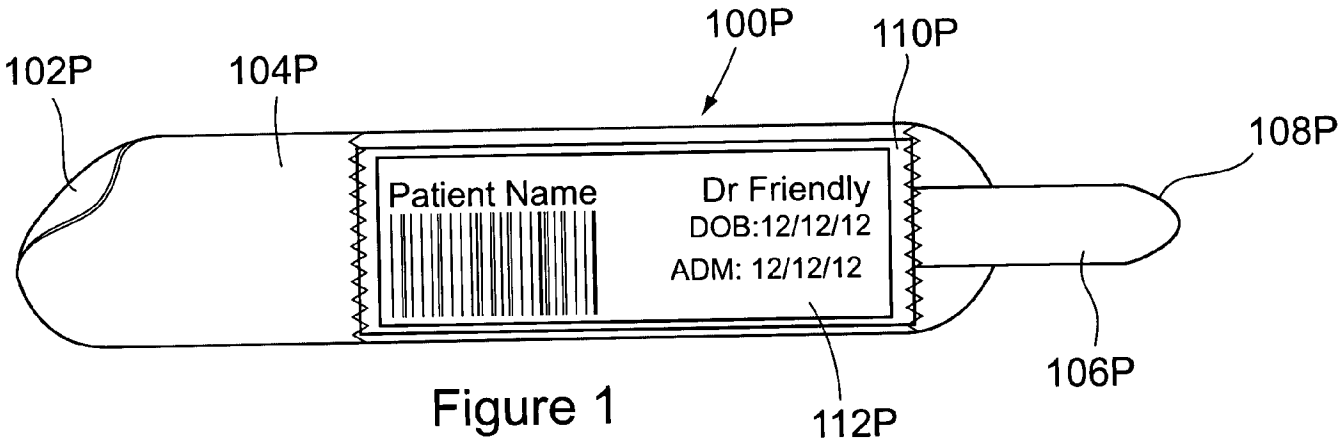
Figure 1 PRIOR ART
FIG. 1 is a plan view of a prior art wristband and label having a cushioning material carrier.
Figure 4:
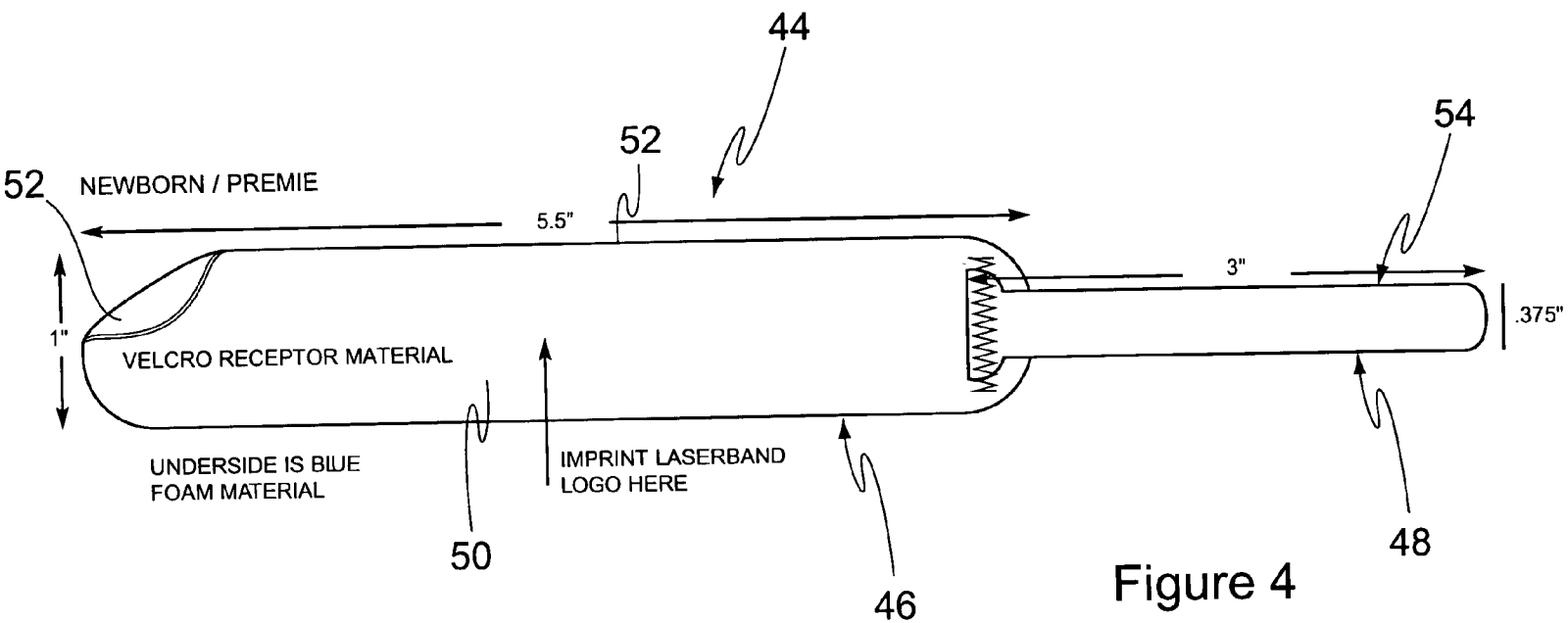
FIG. 4 is a top view of the cushioned carrier depicting the Velcro™ strap sewn to one side thereof for attachment of the self-laminating hang tags depicted in FIGS. 2 and 3.

The carrier 44 is shown in FIG. 4. It includes a band portion 46 and a strap portion 48. The band portion 46 is of multilayer construction with a top layer 50 of the "loop half" of a Velcro™ fastener material and a bottom layer 52 of a cushioned material which is preferably any soft foam or sponge-like material which may also be of surgical grade. The Velcro™ strap 48 has a lower surface 54 comprised of the "hook half" of a Velcro™ fastener such that as the carrier 44 is wrapped around a baby's wrist, the Velcro™ hook surface 54 may be brought to overlie the Velcro™ loop surface and attach the two ends of the carrier 44 and complete the wristband.

As shown in the preferred embodiment, the strap portion may be preferably sewn on to the end of the carrier or band portion 46 and be approximately 3 inches long by ⅜ inches wide. The hang tag cinch slots 43 are sized appropriately to receive and pass the strap portion 48 therethrough and allow an end of the strap portion 48 to extend beyond the second cinch slot 43 for exposure to the loop portion 50.

Figure 5:
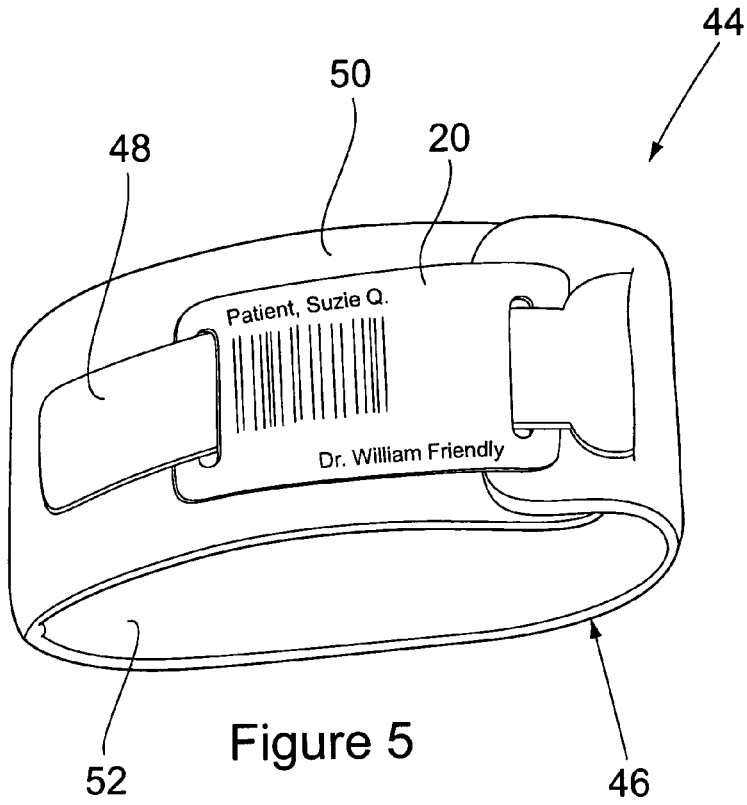
FIG. 5 is a perspective view of an assembled wristband with the strap threaded through both of two cinch slots.
Figure 6:
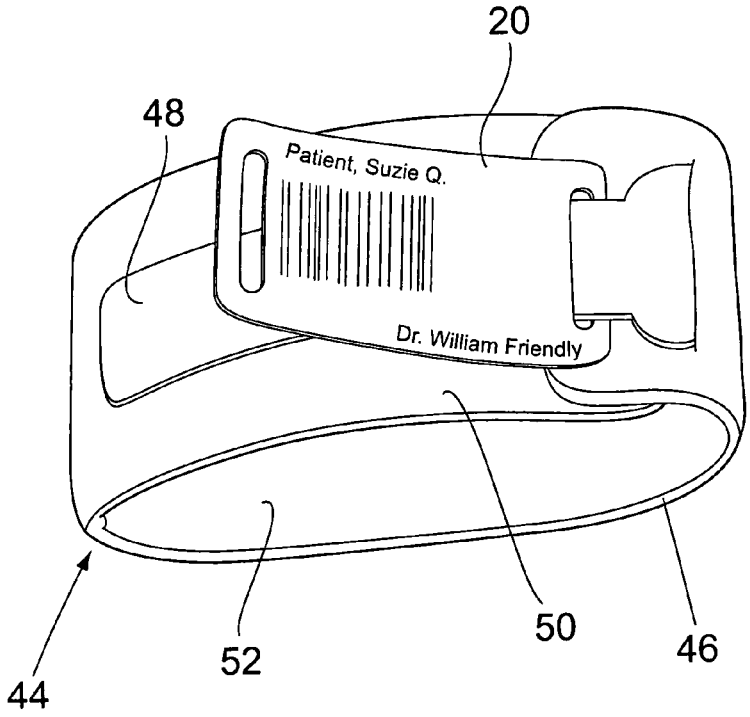
FIG. 6 is a perspective view of an assembled wristband with the strap threaded through one of the cinch slots.

In use, the hang tags in the form of a sheetlet or page sized form are conveniently processed through a laser printer or the like at which time the patient's name or other identifying information is applied to the imaging area. A hang tag may then be separated from the sheetlet or page sized form, and the carrier strap inserted through one or both of the cinch slots. As shown in FIG. 5, the hang tag may be positioned on the strap so that the extra length of the strap extends beyond the outboard cinch slot so that the maximum size "tongue" extends beyond for attachment to the loop material on the back of the carrier. Also, in FIG. 5 the carrier is shown as overlapping so that only the cushion material forming the carrier contacts the patient's skin. This arrangement is similarly shown in FIG. 7. With this arrangement, it is thought that maximum comfort is provided to the patient as the carrier may be "snugged" about the wrist, or ankle, so as not to be tight but to be firmly secured and yet just the cushion material is softly compressed against the skin. A second configuration is shown in FIG. 6, as the strap is threaded through only one of the two cinch slots. Although FIG. 6 shows the strap inserted through the inboard cinch slot, the strap may be similarly inserted through the outboard slot, depending on the choice of the nurse. One or the other of the slots might be chosen to facilitate access to a bar code on one side or the other of the hang tag, for example, or for any other reason including merely personal preference. Again, in FIG. 6 as in FIG. 5, the carrier is shown as overlapping, for maximum comfort. However, the carrier could be arranged to not overlap, for example should a longer length wristband be needed, although that application is not contemplated by the inventor as preferable as it possibly exposes rough edges and surfaces to the patient's skin.

Figure 7:
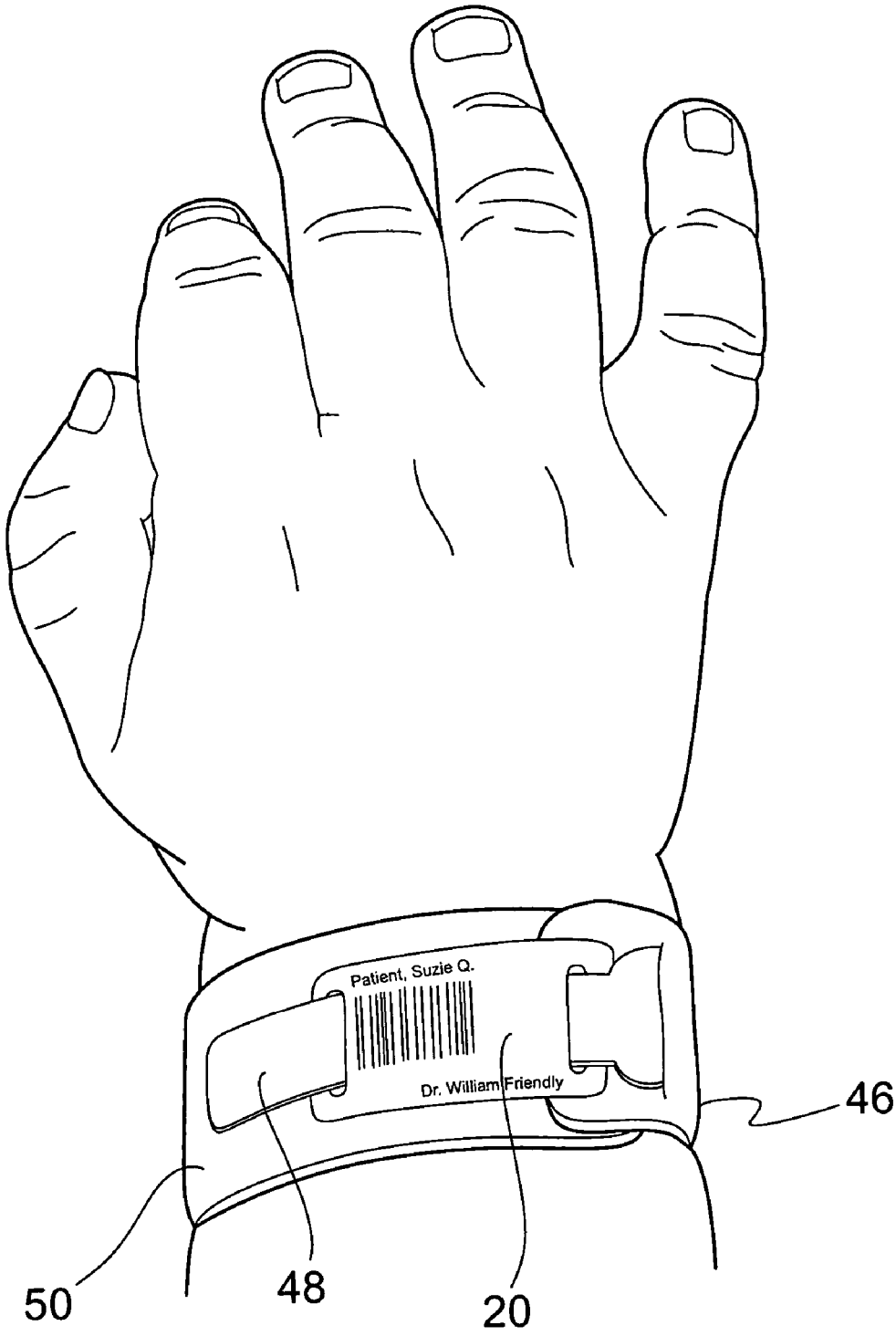
FIG. 7 is a perspective view of an assembled wristband applied to a patient's wrist.

As shown in FIG. 7, the wristband is conveniently arranged to encircle the patient's wrist, and may be "snugged" against the wrist to hold it in place, with the information on the hang tag exposed for ready viewing and access for example to read a bar code imprinted thereon. With this arrangement, the wristband will resist unintentional migration or movement which would obscure the patient information. However, as noted above, the length of the wristband compared to the size of the patient's appendage will in some cases limit the choice for applying the wristband in this overlapping configuration or not. While a short gap between the two ends of the carrier might well be acceptable due to the relative thickness of the carrier, too long a gap would potentially expose the "hook" surface of the strap to the patient's skin as well as shorten the amount of strap hook surface contacting the loop surface which might compromise the integrity of the attachment. Therefore, while the design of the wristband does provide some adjustability, some care must be used in choosing the right size wristband for the particular patient.

The invention has been described in terms of a preferred embodiment as shown in the drawings and described above. However, the invention should not be considered as limited to the specifics of this preferred embodiment as various changes and alternatives to the specific disclosure would be apparent to those of skill in the art and are included within the teaching of the invention. For example, various kinds of materials may be used for the band portion of the carrier, various dimensions and lengths can be chosen as convenient for the various portions of the carrier such as the band and the strap, the strap may be secured to the band portion by any convenient attachment means including a hook-and-loop fastener, snap, etc., the hang tag could be preprinted with information desired to be included, such as special precaution conditions or other warnings or indications relating to the medical condition or treatment of the patient, a cinch slot could be provided on only one side of the hang tag instead of both sides or moved to different areas on the hang tag, a wristband could function as a hang tag by cutting off the strap portion, and other similar changes. Furthermore, although explained as intended for principal use for baby patients, the wristband of the present invention may also be used for any patient for increased comfort and reduced risk of abrasion, rash, or unintentional injury for those patients with skin integrity issues such as burn victims, elderly patients, etc. As such, the present invention should only be considered as limited by the scope of the claims appended hereto and their legal equivalents.

What is claimed is:

1. A cushioned wristband with separable printable self-laminating label, said wristband comprising a layer of cushion material for contacting the wearer's wrist, a strap extending to one side of said cushion material, a self-laminating label for separable, mechanical attachment to the wristband, said separable mechanical attachment comprising slots at opposing ends through which said strap may be inserted to thereby secure and display one side of said label in a planar orientation substantially adjacent the wearer's wrist as the wristband is worn and a layer of one of either hook or loop material backing covering at least a portion of the cushion material and the strap has a surface of the other of the hook or loop material, and the label has a width smaller than the wristband and the strap is positioned so that the label, when attached to the wristband, is spaced inwardly from each side of the wristband to minimize the opportunity for the label's edges to come in contact with the wearer's wrist as the wristband is worn, and a wristband attachment for securing the strap so that it remains inserted through said slots.

2. The wristband of claim 1 wherein the strap is sufficiently long to be inserted through each of said slots and beyond to attach to the backing as the wristband is applied to a user.

3. The wristband of claim 2 wherein the label comprises a printable face stock portion and a laminating portion, said laminating portion being approximately twice the size of said printable face stock portion so that the laminating portion may be folded over to substantially encapsulate the face stock portion.

4. The wristband of claim 3 wherein the strap has a width smaller than the width of the wristband and sized to allow its ready insertion through the label slots without allowing canting of the label sufficient for the label to extend beyond the edge of the wristband after the wristband is applied to a wearer.

5. The wristband of claim 4 wherein the label is separable from a two-layer business form, the form being arranged for printing of the face stock portion by a printer under computer control prior to separation from the form.

6. The wristband of claim 5 wherein the strap is attached to the loop material and arranged so that after insertion through at least one of the label slots the strap may be wrapped around the wearer's wrist and past the opposite edge of the wristband for attachment to the backing so that the wearer's wrist is completely encircled by the cushion material and the label is located outside the wristband.

7. A cushioned wristband arranged to receive a separable, mechanically affixed label, the wristband having a carrier comprised of an inside layer of cushion material and an outside layer of either hook or loop material, and a strap affixed near an edge of the carrier, the strap having a layer of the other of either the hook or loop material, the strap being sized to insert through at least one slot formed in a label and then wrap around the user's wrist for attachment of the strap to the outside layer as the wristband is applied to a user's wrist, the strap further being positioned with respect to the carrier so that as the wristband is wrapped in a generally aligned orientation about the user's wrist the strap once attached will be spaced from either edge of the carrier so as to minimize contact between the strap and the user's wrist.

8. A label for attachment to the wristband of claim 7, said label comprising a self laminating label formed from two plies of material.

9. The wristband/label combination of claim 8 wherein said two plies comprise a face ply area for receiving a printed image and a laminating ply for over-laminating the face ply area.

10. The wristband/label combination of claim 9 wherein said at least one slot is formed in the laminating ply.

11. The wristband/label combination of claim 10 wherein the laminating ply includes two slots, the two slots being arranged on opposing sides of the face ply area.

12. The wristband/label combination of claim 8 wherein said label comprises a self-laminating label, the label having at least one slot arranged near a side thereof and sized for receiving the strap therethrough.

13. The wristband/label combination of claim 12 wherein said label has a slot near each of two opposing sides of said label and sized so that the strap may be inserted through both of said slots.

14. The wristband/label combination of claim 13 wherein said outside layer is loop material and the strap is hook material, and wherein the strap is affixed to said carrier with sewn thread.

15. The wristband/label combination of claim 13 wherein said cushion material is sized for said intended user so that the cushion material completely encircles the user's wrist as the wristband is applied, thereby positioning the label once attached outside the wristband and not in contact with the user's skin.

16. The wristband/label combination of claim 12 wherein said label comprises a layer of face stock and a layer of lamination, the label being arranged in a business form for imaging by a printer before separation therefrom and self lamination into a label for attachment to the wristband.

17. A cushioned wristband comprising a wristband carrier, said wristband carrier having a cushion material surface and a loop material surface, a hook strap affixed to the carrier and extending to one side thereof, and a self laminating label having a face ply area for receiving a printed image and a laminating ply for laminating the face ply area, a width smaller than the hook strap, and two slots at opposing ends of said label, each of said slots being adapted to receive the hook strap therethrough, and the hook strap being sufficiently long to extend through each of said slots, for attaching the label to the hook strap and thus to the wristband in a generally planar orientation, said slots being sized and arranged so that upon attaching the wristband to a wearer's wrist the label is secured about the hook strap and in a spaced relation to each of the hook strap's sides so as to minimize the opportunity for the edges of the label to contact the wearer's wrist as the wristband is worn.

18. The cushioned wristband of claim 17 wherein said slots are formed in said laminating ply.

19. The cushioned wristband of claim 18 wherein said label is formed in a business form, the business form having at least two plies, and wherein each of said face ply area and said laminating ply are formed by die cuts in said two plies.

* * * * *